US005682586A

United States Patent [19]

Stephany et al.

[11] Patent Number: 5,682,586

[45] Date of Patent: Oct. 28, 1997

[54] MAGNETIC BRUSH DEVELOPMENT ROLLER FOR AN ELECTROGRAPHIC PRINTER

[75] Inventors: Thomas M. Stephany, Churchville; William Mey, Rochester; Carl N. Worden, Caledonia, all of N.Y.

[73] Assignee: Eastman Kodak Company, Rochester, N.Y.

[21] Appl. No.: 767,356

[22] Filed: Dec. 18, 1996

[51] Int. Cl.[6] ..... G03G 15/00; G03G 15/09

[52] U.S. Cl. ..... 399/276; 347/55; 399/267

[58] Field of Search ..... 399/276, 267; 347/55, 150, 141, 158; 346/74.2

[56] References Cited

U.S. PATENT DOCUMENTS 3,879,737 4/1975 Lunde ..... 347/55

3,914,771 10/1975 Lunde et al. ..... 346/74.2

4,344,694 8/1982 Ruh ..... 399/276 X 5,181,075 1/1993 Rubin ..... 399/267

5,444,470 8/1995 Muto et al. ..... 347/55 X

*Primary Examiner*—Arthur T. Grimley

*Assistant Examiner*—Sophia S. Chen

*Attorney, Agent, or Firm*—Thomas H. Close

[57] ABSTRACT

A magnetic brush development roller assembly for an electrographic printer, includes a cylindrical multipole magnet mounted for rotation about a cylindrical axis within a cylindrical shell. The stationary shell surrounding the multipole magnet defines an axial slot for receiving an imaging head, and has an increased thickness in the neighborhood of the slot and a reduced thickness in a neighborhood diametrically opposite the slot, whereby eddy currents generated by rotation of the magnet within the shell and hence drag on the magnet are reduced.

3 Claims, 3 Drawing Sheets

MAGNETIC BRUSH DEVELOPMENT ROLLER FOR AN ELECTROGRAPHIC PRINTER

CROSS-REFERENCE TO RELATED APPLICATIONS

Reference is made to U.S. Ser. No. 08/294,294, filed Aug. 23, 1994, now abandoned on Dec. 31, 1996, entitled "Electrographic Printing Process and Apparatus" by William Mey et al., and to Ser. No. 08/620,655, filed Mar. 22, 1996, entitled "MICROCHANNEL PRINT HEAD FOR ELECTROGRAPHIC PRINTER" by William Grande, et al.

FIELD OF THE INVENTION

The invention relates generally to the field of electrography, and in particular to electrographic printing methods and apparatus.

BACKGROUND OF THE INVENTION

U.S. Pat. No. 3,914,771 issued on Oct. 21, 1975, to Lunde et al, details an electrographic printer which selectively transfers toner particles directly onto a receiver. It incorporates a magnetic brush assembly 10, which is detailed in FIG. 1. This Prior Art brush assembly includes an imaging head 12 that is located within a slot on the exterior surface of the shell 14, and is substantially flush with the surface of the shell. It also includes a rotatable multi-pole magnet 16, mounted within the shell 14. FIG. 2 shows a second arrangement wherein the imaging head 12 is mounted directly upon the shell 14. The first arrangement is preferred since it eliminates the need for a ramp 19 to deliver toner particles to the imaging head 12, and provides a channel for electrical connections to the head. This slotted method of assembly, while easing the complexity of attaching the imaging head 12 to the shell 14, also creates a problem in manufacturing if the shell is conductive. The act of machining the slot 18, shown in FIG. 3, requires that the outside diameter of the shell 14 be increased by at least the thickness of imaging head 12 to maintain the structural integrity of the shell. The increased thickness of the metal, however, decreases the electro-mechanical efficiency of the magnetic brush 10. The rotation of the multi-pole magnet 16, within shell 14 by drive motor 20, generates eddy currents within the shell 14. Because these eddy currents increase with the thickness of the shell 14, this creates an increased load on the drive motor 20, causing increased current consumption. This in turn causes an increase in heating of both the motor 20 and the shell 14.

There is a need therefore for an improved magnetic brush development roller assembly that avoids the shortcomings noted above.

SUMMARY OF THE INVENTION

The present invention is directed to overcoming one or more of the problems set forth above. Briefly summarized, according to one aspect of the present invention, a magnetic brush assembly for an electrographic printer, includes a cylindrical multipole magnet mounted for rotation about a cylindrical axis within a cylindrical shell. The stationary shell surrounding the multipole magnet defines an axial slot for receiving an imaging head, and has an increased thickness in the neighborhood of the slot and a reduced thickness in a neighborhood diametrically opposite the slot, whereby eddy currents generated by rotation of the magnet within the shell and hence drag on the magnet are reduced.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

To facilitate understanding, identical reference numerals have been used, where possible, to designate identical elements that are common to the figures.

DETAILED DESCRIPTION OF THE INVENTION

Figure 1:
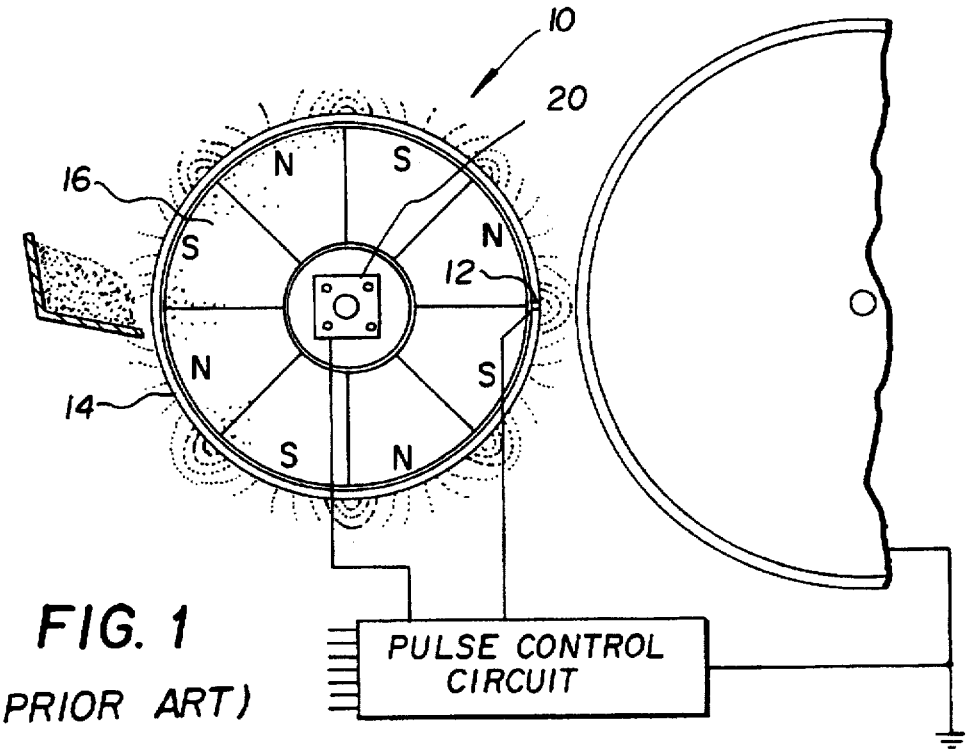
FIG. 1 (PRIOR ART)
FIG. 1 is a schematic diagram showing a prior art magnetic brush for use in an electrographic printer.
Figure 2:
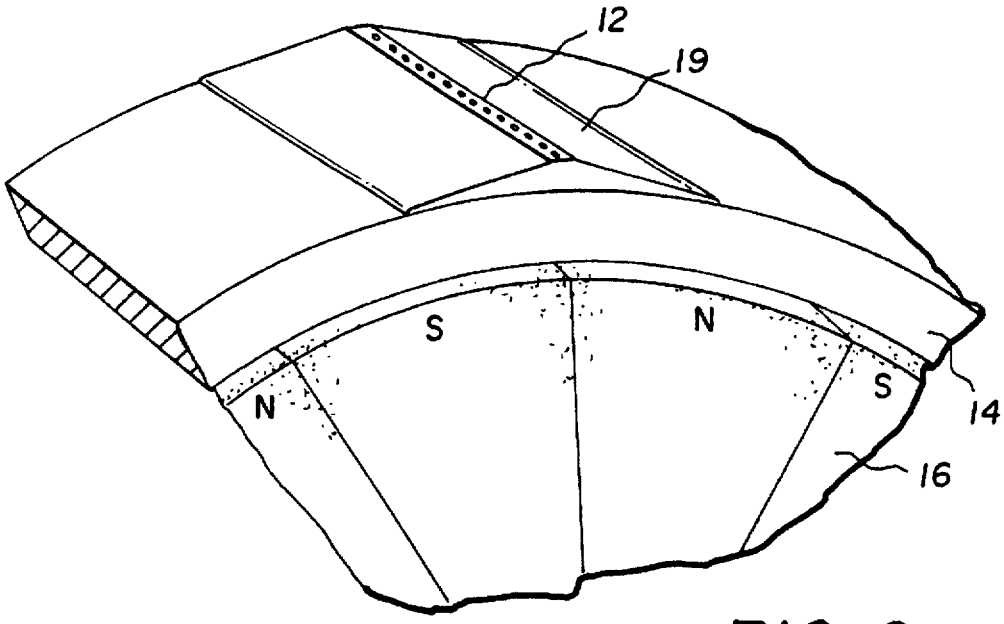
FIG. 2 (PRIOR ART)
FIG. 2 is a partial perspective view of an alternative prior art arrangement of a magnetic brush assembly.
Figure 3:
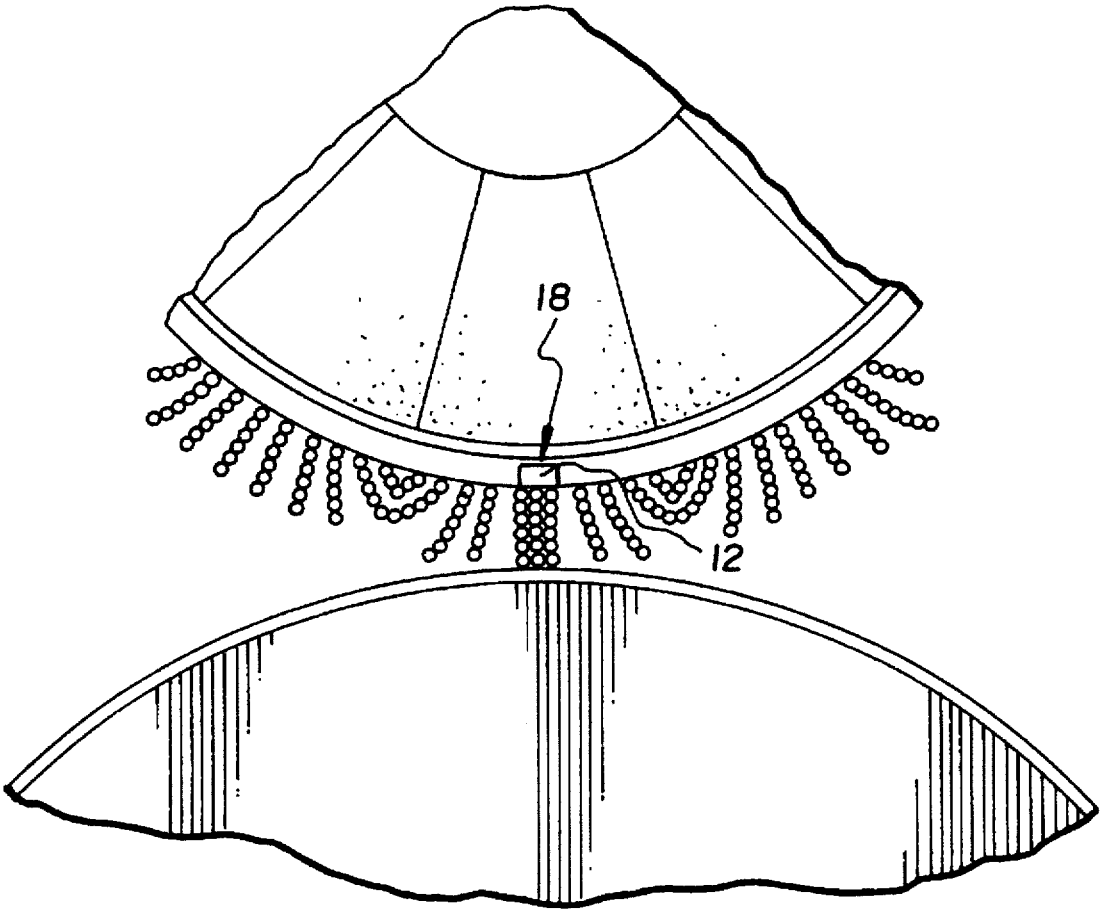
FIG. 3 (PRIOR ART)
FIG. 3 is a partial side view of the prior art magnetic brush shown in FIG. 1.
Figure 4:
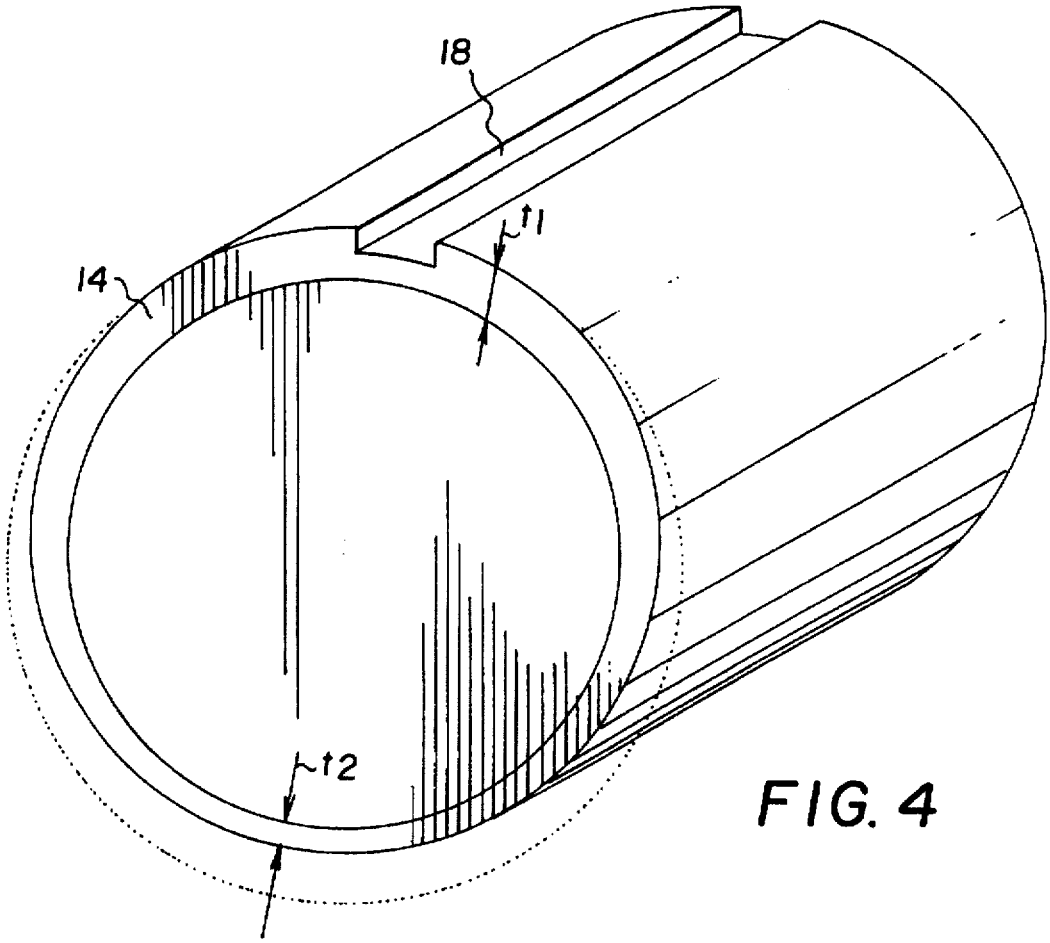
FIG. 4 is a perspective view of the shell of a magnetic brush according to the present invention.
Figure 5:
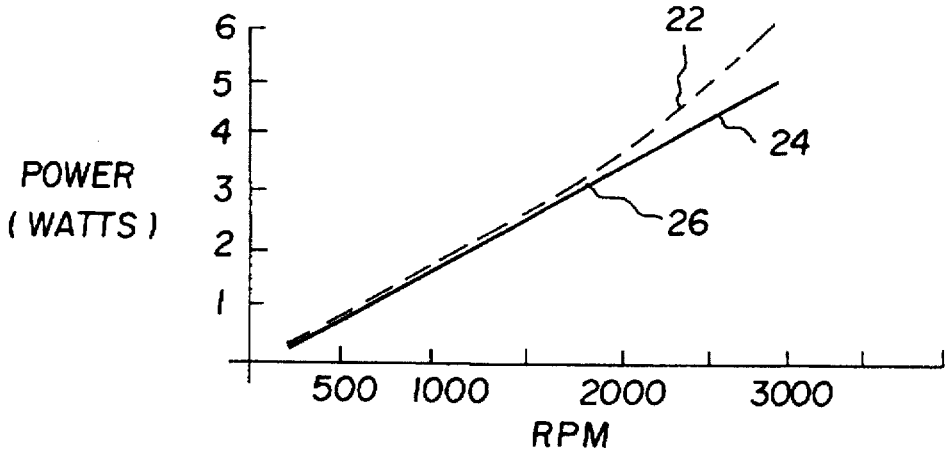
FIG. 5 is a graph showing the relative power consumption of a prior art magnetic brush and a magnetic brush according to the present invention.

Referring now to FIG. 5, the present invention is directed to an improved shell 14 for magnetic brush 10. The shell 14 is a conductive, non magnetic material, preferably non magnetic stainless steel. The neighborhood of the shell defining the slot 18 for receiving the imaging head 12 is relatively thick, having a thickness $t_1$, to provide sufficient structural integrity in the neighborhood of the slot The neighborhood of the shell diametrically opposite the slot 18 is relatively thin, having a thickness $t_2$, that minimizes eddy current drag.

Preferably, the shell 14 according to the present invention is formed from a tube of non magnetic stainless steel by an offset manufacturing process such as offset grinding or rotational machining. A magnetic brush having a 12 pole magnet of approximately 2.5 cm in dia. by 7 cm long and a first prior art type non-magnetic stainless steel shell 1.1 mm thick and a second offset shell having a thickness of 0.5 mm in the relatively thin neighborhood and 1.1 mm in the relatively thick neighborhood were constructed. Test results comparing the magnetic brush with the two shells are shown in FIG. 5, where the power usage with the prior art shell is plotted with the dashed line 22 and the power usage with the shell of the present invention is shown by solid line 24. As shown in the graph, at lower RPM levels (e.g. 0 to about 2000 RPM) of the multi-pole magnet 16 there is not a significant advantage of one shell configuration over another. However, at higher rotational velocities (e.g. greater than about 2000 RPM) which are typical of a higher page throughput machine (e.g. 10 pages per minute), a break off point (26) occurs where the shell configuration of the present invention consumes increasingly less power than the uniform shell for the same RPM levels. Depending on the number of poles on the multi-pole magnet 16, 10–13% less power was consumed at about 3100 RPM, indicating that superiority of the present invention.

The invention has been described with reference to a preferred embodiment. However, it will be appreciated that variations and modifications can be effected by a person of ordinary skill in the art without departing from the scope of the invention.

PARTS LIST

10 magnetic brush development roller
12 imaging head

14 shell
16 magnet
18 slot
19 ramp
20 motor
22 power usage curve
24 power usage curve
26 break point

We claim:

1. A magnetic brush development roller assembly for an electrographic printer, comprising:

a) a cylindrical multipole magnet mounted for rotation about a cylindrical axis; and b) a stationary shell surrounding the multipole magnet, the shell defining an axial slot for receiving an imaging head, and having an increased thickness in the neighborhood of the slot and a reduced thickness in a neighborhood diametrically opposite the slot, whereby eddy currents generated by rotation of the magnet within the shell and hence drag on the magnet are reduced.

2. The magnetic brush development roller assembly claimed in claim 1, wherein the shell is non-magnetic stainless steel.

3. The magnetic brush development roller assembly claimed in claim 1, wherein the neighborhood of increased thickness is two times the thickness of the neighborhood of decreased thickness.

* * * * *